United States Patent [19]

Cooper et al.

[11] Patent Number: 4,509,220

[45] Date of Patent: Apr. 9, 1985

[54] PREVAILING TORQUE NUT

[75] Inventors: David C. Cooper, Oakville; Kenneth J. Bouchard, Scarborough, both of Canada

[73] Assignee: Stelco Inc., Hamilton, Canada

[21] Appl. No.: 447,411

[22] Filed: Dec. 6, 1982

[51] Int. Cl.[3] ..... B21D 53/24

[52] U.S. Cl. ..... 10/86 A; 10/165; 10/79; 221/210; 414/126; 414/128

[58] Field of Search ..... 10/165, 86 A, 79; 221/171, 172, 173, 210; 414/125, 126, 128, 457

[56] References Cited

U.S. PATENT DOCUMENTS

| | | | |
|---|---|---|---|
| 3,472,400 | 10/1969 | Morton et al. | 10/165 |
| 3,486,179 | 12/1969 | Beutler et al. | 10/86 A |
| 3,496,582 | 2/1970 | Johnson | 10/86 A |

*Primary Examiner*—W. D. Bray

*Attorney, Agent, or Firm*—Sim & McBurney

[57] ABSTRACT

A method and apparatus is provided for making a prevailing torque nut from a regular nut. The regular nut is placed between two anvil members, and a gap between the anvil members is first decreased so that they contact the nut on opposite sides. Then, the gap between the anvil members is further decreased by a preset amount, in order to permanently inwardly deform the nut. By making the preset amount a constant quantity, a plurality of nuts having slightly different outside and inside dimensions can be consistently deformed. A feature of this invention is the provision of a deformation apparatus which smoothly, progressively and consistently deforms a nut from one end to another. To accomplish this, the anvil members which cause the deformation have oblique working surfaces which taper toward each other, and which are adapted to bear against the nut over substantially the whole of the length of the nut, with the exception of an integral washer if such is present.

17 Claims, 16 Drawing Figures

PREVAILING TORQUE NUT

This invention relates generally to prevailing torque nuts, particularly of the kind used in the automotive industry, and in other areas such as appliances, agriculture and lawn mowers, where vibration and loss of fastening is significant.

BACKGROUND OF THIS INVENTION

Prevailing torque nuts are (usually) a deformed version of a hexagonal nut, often with an integral flange washer, and the intention is for the binding and prevailing torque to take place between the threads of the nut and the bolt (screw, stud or other externally threaded element), as the nut is threaded onto the bolt. Normally, the nut is applied with a power wrench or other method, and the person carrying out this operation will preset the wrench to a specified value, in accordance with a tightening specification. If the assembly subsequently loosens, the nut will remain in place and will strongly resist being shaken loose through vibration because of the prevailing torque.

Although there are numeous methods available, many of which are patented, for applying a deformation to a hexagonal nut in order to deform it or at least a portion of it, so that binding will take place between the nut and the bolt on which it is threaded, to date a satisfactory degree of consistency of deformation has been lacking. This has meant that many of the produced nuts were rejects, as being either too greatly deformed or too little.

GENERAL DESCRIPTION OF THIS INVENTION

In view of the foregoing disadvantage of known methods for deforming hexagonal nuts, it is an aspect of this invention to provide a method and apparatus for carrying out such deformation, which is capable of carrying out a very uniform deformation of standard and special undeformed hexagonal nuts, thus resulting in an output with few or no rejects.

It is a further aspect of this invention to provide a deformed nut, exhibiting superior characteristics as a prevailing torque nut and capable of specified prevailing torque when maximum material nut is applied to maximum material bolt and minimum material bolt.

"More particularly, this invention provides a method of making a prevailing torque nut from a regular nut, that includes at least one pair of opposed external facets, the method including the steps of first placing the regular nut between two anvil members which have oblique working faces, the nut being oriented so that the opposed facets face the anvil members, then decreasing the spacing between the anvil members so that they contact the facets over substantially the full axial height of the nut, and finally further decreasing the spacing between the anvil members by a preset amount, to permanently inwardly deform the nut in a graduated manner.

According to another aspect of this invention, there is provided a method of feeding a hexagonal nut to a location between two parallel anvil members in such a way that the nut is oriented with two opposed flats parallel with the anvil members. The method includes first passing the nut along a first track defined between first and second edges spaced apart a distance greater than the corner-to-corner diametral dimension of the nut, then providing a second track continuous with the first track and defined between third and fourth edges spaced apart by a distance greater than the flat-to-flat diametral dimension of the nut but less than the corner-to-corner diametral dimension thereof, and then, laterally adjacent the junction between the two tracks, reciprocating a contact element longitudinally of the tracks while allowing the element some lateral freedom of movement, whereby if the nut tries to enter the second track, the contact element rotates the nut so that its flat dimension is across the track.

According to another aspect, this invention provides apparatus for converting regular nuts into prevailing torque nuts. The apparatus includes two anvil members having oblique working surfaces, delivery means for placing the regular nuts sequentially between the anvil members, and power means for controlling the spacing between the anvil members such that (a) the anvil members first come into contact with opposite sides of a nut located between them over substantially the full axial height of the nut, and then (b) the spacing between the anvil members decreases by a predetermined amount which is the same for all nuts within a given size range, whereby to permanently inwardly deform each nut in a smooth and progressive manner from one end of the nut to the other.

Finally, according to another aspect of this invention, there is provided a delivery apparatus for feeding a hexagonal nut to a location between two parallel anvil members in such a way that the nut is oriented with two opposed flats parallel with the anvil members, the apparatus comprising:

a first track defined between first and second edges spaced apart a distance greater than the corner-to-corner dimension of the nut, a second track continuous with the first track and defined between third and fourth edges spaced apart by a distance greater than the flat-to-flat dimension of the nut but less than the corner-to-corner dimension thereof, the second track leading to the location between the anvil members, and a contact element located at the junction between the two tracks, and means for reciprocating the contact element longitudinally of the tracks while allowing the element some lateral freedom of movement, whereby if a nut tries to enter the second track with its corner-to-corner dimension across the track, the contact element rotates the nut so that its flat-to-flat dimension is across the track.

GENERAL DESCRIPTION OF THE DRAWINGS

One embodiment of an apparatus constructed in accordance with this invention is illustrated in the accompanying drawings, in which like numerals denote like parts throughout the several views, and in which:

FIG. 2 is an elevational view of one portion of the apparatus in FIG. 1, seen straight-on;

DETAILED DECRIPTION OF THE DRAWINGS

Figure 1:
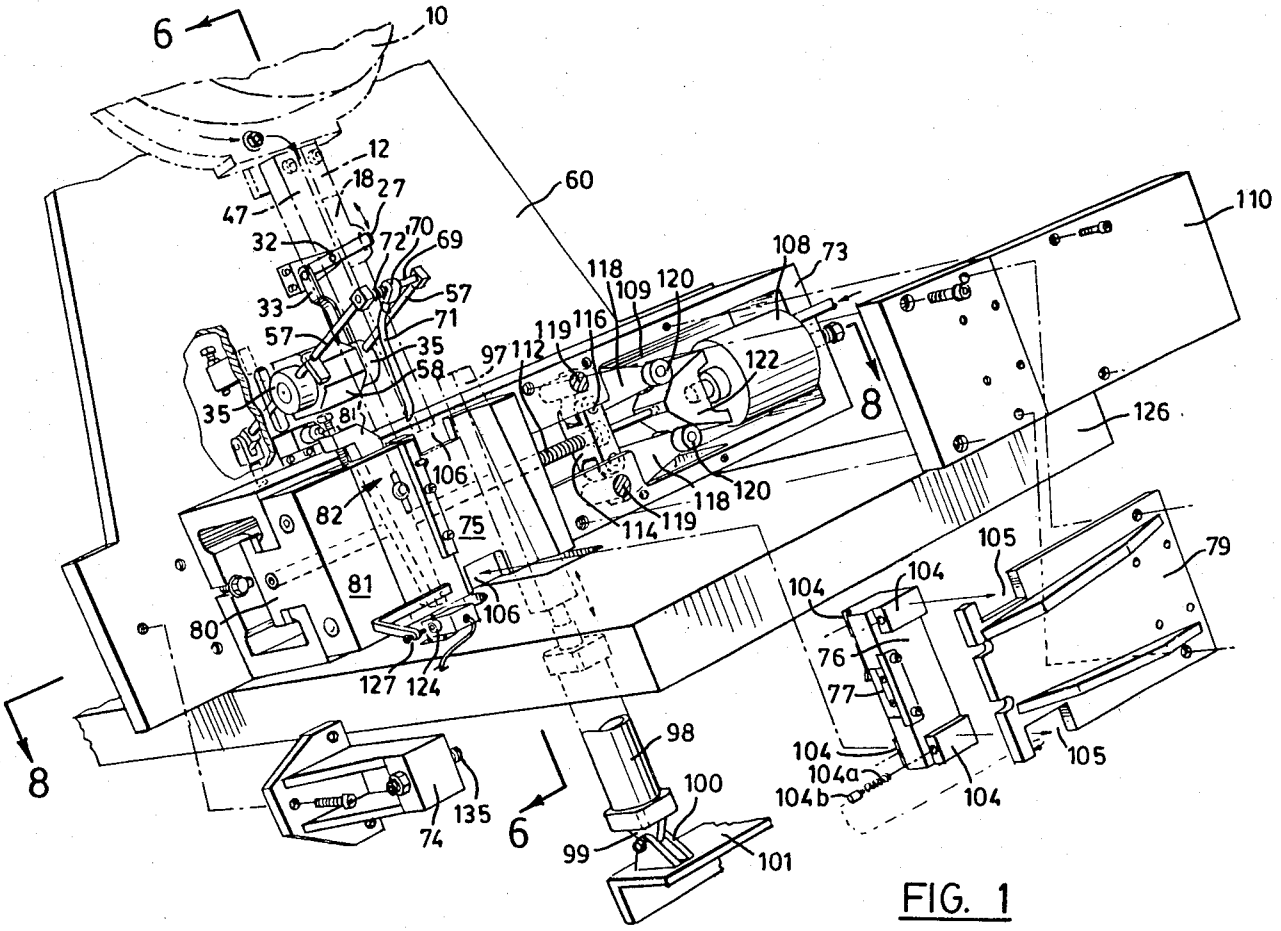
FIG. 1 is a partly exploded perspective view of the overall apparatus.

Attention is first directed to FIG. 1, which shows the main components of an apparatus designed to deform nuts into prevailing torque nuts.

In FIG. 1, a hopper 10 is designed to feed nuts into a guideway 12 shown in broken lines. The hopper is of standard construction, and does not require detailed discussion herein. The guideway 12 is shown in solid lines in FIG. 2, where it can be seen that the guideway 12 has an upper, wider portion 13 and a lower, narrower portion 14. A nut 15 is shown in the upper portion 13 of the guideway 12, and the sectional view shown in FIG. 3 illustrates that the guideway at this location is wide enough to accept the nut if it is oriented with the corners horizontal, i.e. its widest dimension.

Figure 4:
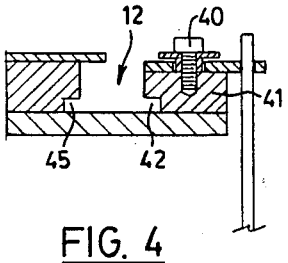
FIG. 4 is a sectional view taken on the line 4—4 in FIG. 2.

However, the lower portion 14 is too narrow to accept a nut across the corners, and the nut must be arranged across the flats in order to pass into the lower portion 14. FIG. 4 shows the relative narrowness of the lower portion 14 with respect to the upper portion 13.

Figure 2:
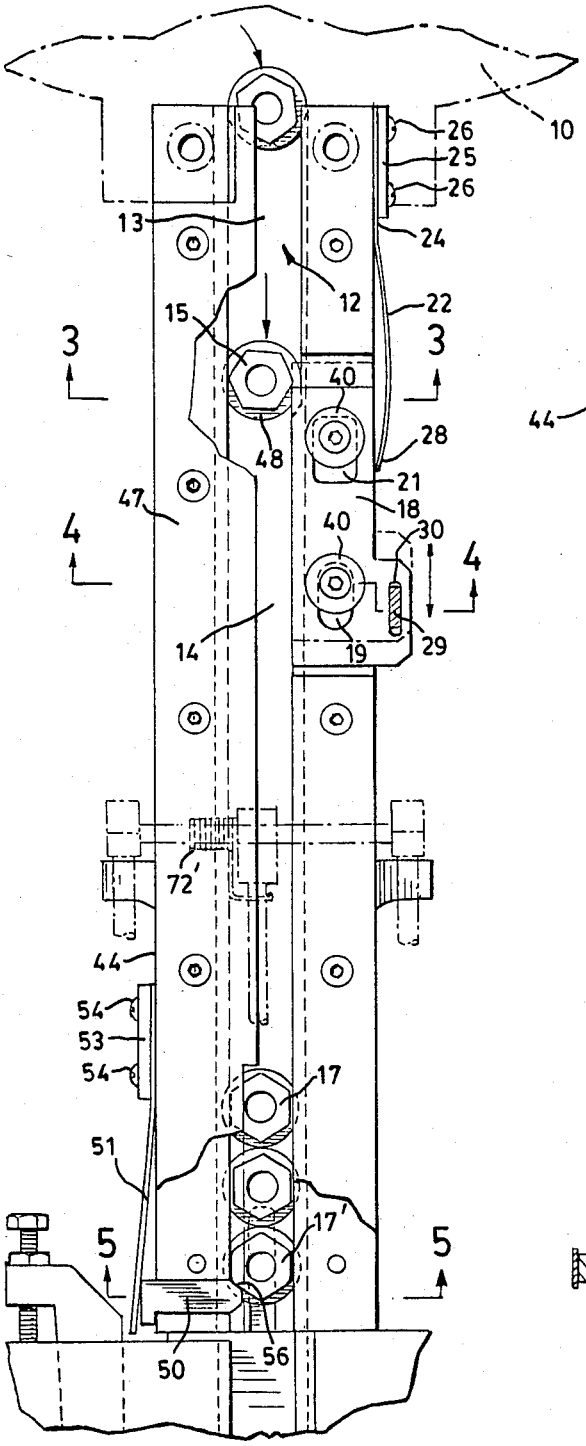
Figure 3:
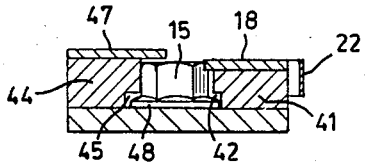
FIG. 3 is a sectional view taken on the line 3—3 in FIG. 2.

Means is provided to "roll" the nuts from a corner-horizontal position such as that shown for the nut 15, to a corner-vertical position such as that shown for the nut 17 in the lower part of FIG. 2. In the corner-vertical position shown by nut 17, the width of the nut across the flats is that which determines its narrowness, and its width is adapted to be received in the lower portion 14 of the guideway 12, as aforesaid.

The means for rolling the nuts consists essentially of the plate 18 which has a lower elongated slot 19, and an upper elongated slot 21. The upper elongated slot 21 is wider than the lower elongated slot 19, for a reason which will be explained below. A leaf spring 22 is also provided, the leaf spring 22 being firmly affixed at 24 to the right-hand side of the guideway 12, through an auxiliary plate 25 and bolts 26, and has its free end 28 pressing leftwardly or inwardly against the upper part of the plate 18. Due to the relative narrowness of the elongated slot 19, the lower part of the plate 18 is constrained laterally, and can move essentially only in a vertical sense. However, the relatively greater width of the upper elongated slot 21 allows a certain degree of lateral motion for the upper part of the plate 18, and this is useful when the plate is "rolling" a nut, such as the nut 15, through a sufficient angle to bring the flats parallel with the guidway 12. The plate 18 is moved up and down by a link 29, which has its forward end projecting through a slot 30 in the plate 18, is pivoted at an intermediate location identified in FIG. 1 by the numeral 32, and has its other end pivotally connected to a further link 33, the lower end 34 of which (see FIG. 6) is pivotally connected to an eccentric location on a boss 35 which is adapted to oscillate about a point 37, in a manner and for a reason which will be explained below.

Figures 6, 7:
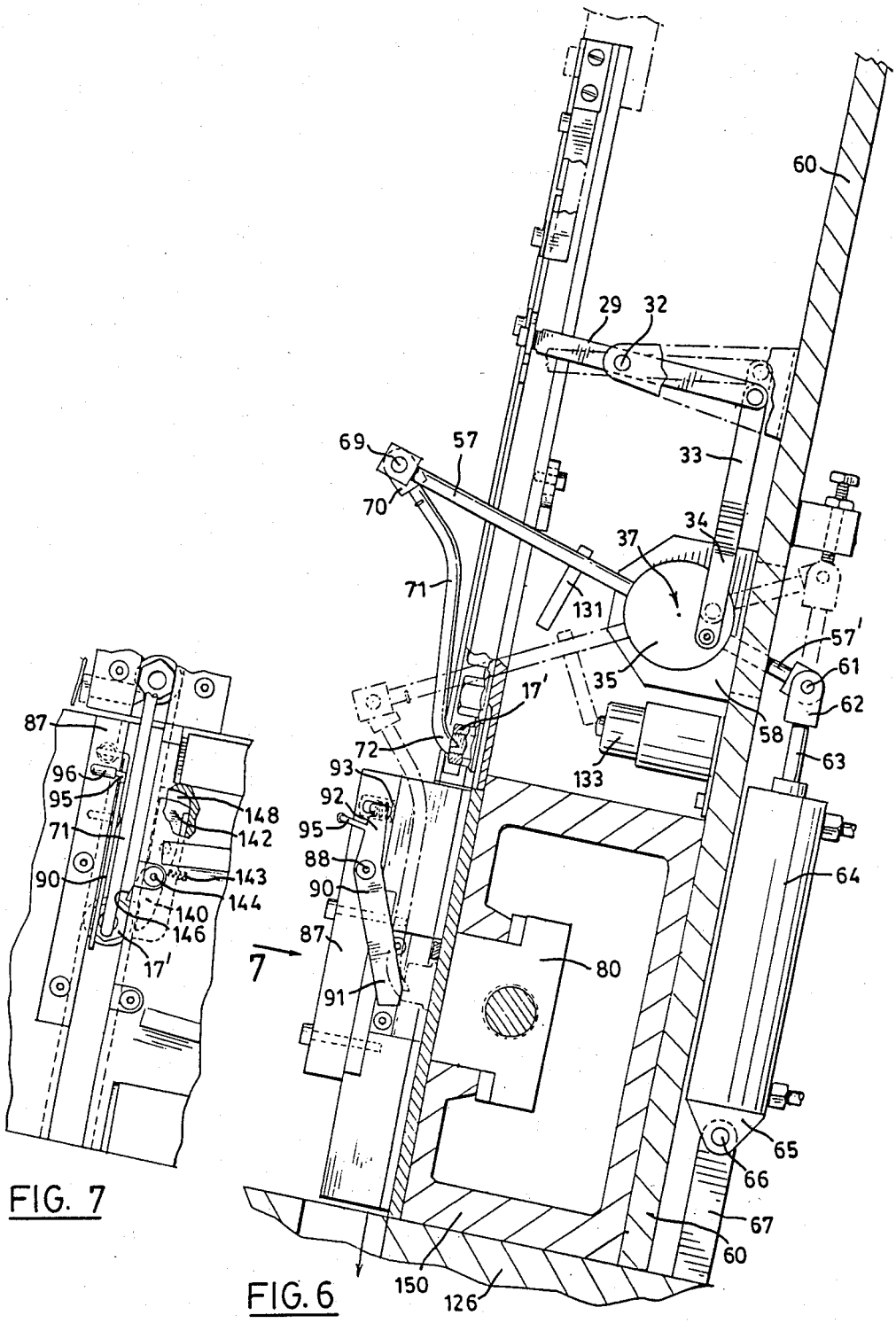
FIG. 6 is a sectional view taken on the line 6—6 in FIG. 1.
FIG. 7 is a view taken looking along the arrow 7 in FIG. 6.

FIG. 6, where the last-mentioned components are shown in side view, it will be seen that oscillation of the boss 35 through approximately 45° will move the link 33 between its solid-line and broken-line positions, which correspondingly will move the plate 18 between its broken-line and solid-line positions seen in FIG. 2. Passing through the slots 19 and 21 are shouldered guide bolts 40, which are not tightened but which hold the plate 18 snugly and slidably against the rightward half of the guideway 12, identified in FIGS. 3–5 as a component 41.

Figure 5:
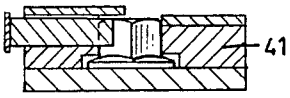
FIG. 5 is a sectional view taken on the line 5—5 in FIG. 2.

Turning more particularly to the FIGS. 3–5, it will be seen that the component 41 has an undercut 42, and that the component 41 is matched on the other side of the guideway 12 by a component 44, also having an undercut 45. The component 44 is greater in height than the component 41, and has affixed to its upper surface a retention plate 47, for the purpose of keeping the nuts in place. As will be appreciated from FIG. 3, the purpose of the undercuts 42 and 45 is to allow for the integral washer 48 of each nut.

It will also be seen that the undercut 42 shown in FIG. 3 appears to be smaller than the same undercut in FIG. 4. The explanation of this relates to the narrowing of the guideway 12 at about the location where the section lines 3—3 are shown. However, the distance between the outside walls of the undercuts 42 and 45 do not change, and thus only the extent of the "overhang" of one of the undercuts needs to be altered in order to accomplish this transition.

Following the progress of a nut through the portion of the apparatus shown in FIG. 2, it can be seen that the nut, after first falling into the guideway 12 from the hopper 10, may or may not become stalled through contact with the plate 18, depending upon the nut's orientation when it reaches that level. If the flats are parallel with the guideway 12, then the nut will slip easily into the lower portion 14 of the guideway 12, whereas if the corners are across the guideway 12, the nut will become stuck until the plate 18 moves upwardly and "rolls" the nut into the other orientation, whereupon it will slip into the lower portion 14 of the guideway 12. The plate 18 oscillates in a regular pattern, as will be explained subsequently, and therefore there is a constant tendency to roll any stuck nuts into the proper orientation to allow them to fall into the lower portion 14 o the guideway 12.

Once in the lower portion 14, the nuts will pass to the lower end, and at the bottom end of the stack seen in FIG. 2 the lowermost nut 17' has become lodged against a stack support latch 50, which is slidable horizontally as seen in FIG. 2, and which is urged rightwardly (i.e., toward the guideway 12) into a blocking position by a leaf spring 51, which is secured against component 44 by an auxiliary plate 53 and suitable machine bolts 54.

As can be seen in FIG. 2, the latch 50 has an oblique camming surface 56, which is such that it will allow a nut to pass downwardly along the guideway 12, thus camming the latch 50 leftwardly out of the way, provided sufficient pressure is brought to bear in a downward direction against the nut attempting to pass the latch 50. The camming surface 56 has substantially the same slope as the mating one of the hexagonal flats of the nut, as can be seen in FIG. 2.

Attention is now directed to FIG. 6 and to FIG. 1, for description of the mechanism whih urges each nut sequentially downwardly past the latch 50. In FIG. 6, there is shown an arm 57 which is one of two arms aligned in FIG. 6, both of these arms bearing the number 57 in FIG. 1. The two arms pass centrally through two aligned bosses 35, these being located on either side of a support block 58, which is secured to a base plate 60.

The two bosses 35 rotate with each other, through a shaft (not seen) which is journalled in the block 58. One of the arms 57 extends diametrically through its respective boss 35, and projects out the other end as a shorter arm 57', the rearward end of which is pivotally connected at 61 to the upper end 62 of the piston 63 of an air or hydrulic cylinder 64, the lower end 65 of which is pivotally mounted at 66 to a bracket 67 secured to the base plate 126.

As the double acting cylinder 64 moves the piston 63 upwardly and then downwardly repeatedly, the connection at 61 will move between the solid-line position and the broken-line position of FIG. 6, thus moving the arms 57 between the solid-line and the broken-line positions. At the leftward or forward ends of the arms 57 is a shaft 69, on which is mounted a member 70 which is journalled for rotation thereabout. Fixed to member 70 is a push arm 71 which is somewhat S-shaped in configuration, as seen in FIG. 6, and which has an indented configuration at its lower end 72. The indented configuration at the lower end 72 defines a V-shaped notch which is adapted to rest against the top face of a nut caught in the lowermost position of the stack shown in FIG. 2, i.e. resting against the latch 50. As can seen in FIG. 6, this V-shaped notch is adapted to grasp the nut and to push it downwardly, as the push arm 71 moves fom its solid-line to its broken-line position in FIG. 6. Spring 72' biases the arm 71 inwardly in FIG. 2.

When the nut is shoved downwardly by the push arm 71, it passes into the second major portion of the apparatus, namely the compensating portion constituted in FIG. 1 by the various components located between a frame 73 and a bracket 74.

Figure 9:
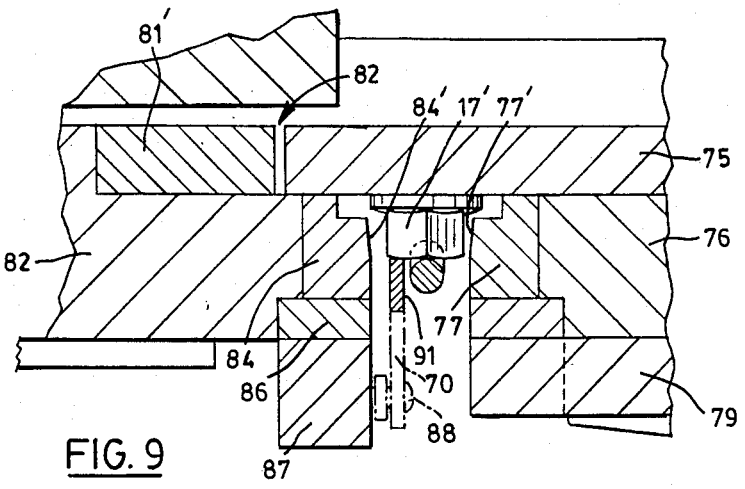
FIG. 9 is an enlargement of the portion inside the circle 9 in FIG. 8, showing the feed stage for a nut.
Figure 10:
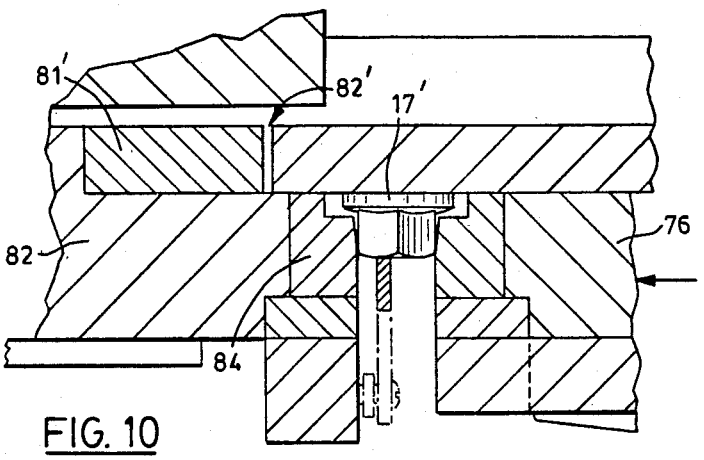
FIG. 10 is a view similar to FIG. 9, showing the compensation stage for a nut.
Figure 11:
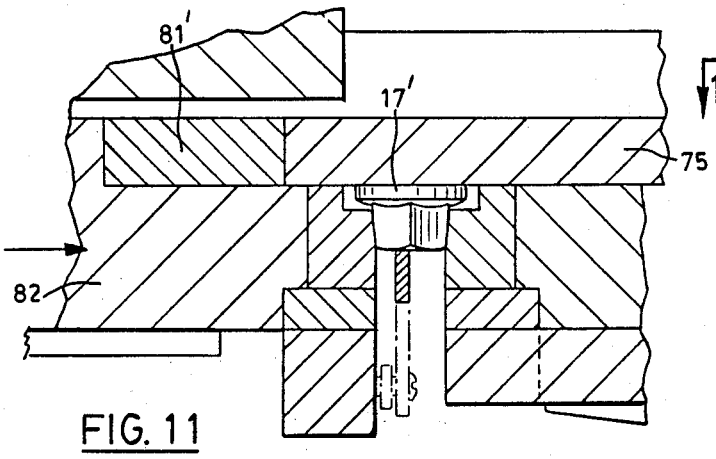
FIG. 11 is a view similar to FIGS. 9 and 10, showing the deformation stage for a nut.
Figure 12:
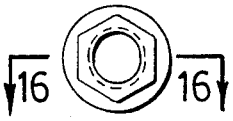
FIGS. 12 and 13 are views of a nut from above and below, respectively, after the nut has been deformed.
Figure 13:
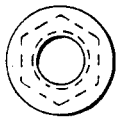

Before describing in detail all of the components just mentioned, attention is directed to FIGS. 9, 10 and 11, in order to allow an understanding of the three-step procedure by which a nut is firstly positioned, then compensated and then deformed. In FIG. 9, a permanently fixed frame member is shown at 75. Slidable against the frame member 75 is a slide block 76, seen in exploded position in FIG. 1. The slide block 76 has affixed to it a hardened anvil 77. A cover plate 79 is provided, to stabilize the slide block 76, and to sandwich the latter between itself and frame member 75.

Opposite from the slide block is located a movable block 80 consisting of portions 81 and 82. Slidably connected with the block 80 is a wedge 81' which will be described more fully below. In the fully opened position shown in FIG. 9, it can be seen that the wedge 81' is situated in such a way that there is a gap 82' between the wedge 81' and the frame member 75. This adjustable gap 82' represents the total permissible rightward movement of the movable block 80 with its components 81 and 82. Supported at the rightward edge of the component 82 is a hardened anvil 84, secured in place by member 86 and 87. It is to be noted that the anvils 77 and 84 (interchangeable to provide varying angles) have sloping contact faces 77' and 84', respectively.

Member 87 supports a pivot connection 88 for a hold-down arm 90 seen in FIG. 6. The hold-down arm 90 is slightly bent, and has a nut-contacting end 91 at its lower end, and an upper end 92 which is biased leftwardly through engagement by a spring 93 (i.e. the hold-down arm 90 is biased in the counter-clockwise direction as seen in FIG. 6, about the pivot connection 88). Integral with the upper part of the hold-down arm 90 is a stop arm 96 (FIG. 7) which is bent to overlie the member 87, and terminates in a convered end 96 adapted to contact the outer (lower in FIG. 9) surface of the member 87 when no nut is in the position shown in FIG. 9. This prevents contact between the lower end 91 of the hold-down arm 90 and the frame member 75. It will be recalled that the nut is in a position in which the flats are parallel with the guideway 12, and since the guideway 12 is also parallel with the working surfaces of components 77 and 84, the nut will appear as seen in FIG. 9, looking downwardly along the space between the components 77 and 84.

FIG. 10 shows the completion of the compensation phase for the nut, in which the slide plate 76 has moved leftwardly to bring the nut 17' over and between anvils 77 and 84. When the nut contacts the anvil 84, a resistance is felt to further leftward movement of the slide plate 76, and this causes an increase in the hydraulic or air pressure moving the slide plate 76 leftwardly, which in turn opens a pressure relief valve to stop the slide plate 76 from moving further. Thus, the nut 17' is merely being held between the two components 77 and 84 in the direction shown in FIG. 10, and has not yet been deformed.

The third phase is shown in completion in FIG. 11, in which the component 82 has moved rightwardly to bring the wedge 81' against the frame member 75, thus causing the pre-determined gap 82' to disappear. The gap 82' has thus precisely determined the extent of deformation of the nut 17', and when contact occurs between the wedge 81' and the frame member 75, no further deformation of the nut 17' can take place.

Figure 8:
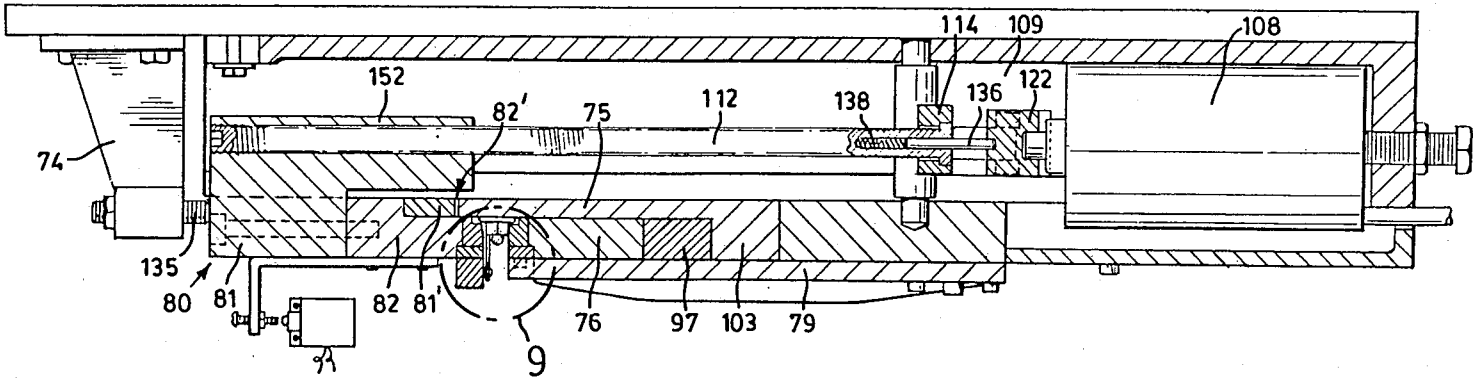
FIG. 8 is a sectional view taken on the line 8—8 in FIG. 1.

Attention is now directed simultaneously to FIGS. 1, and 8–11. The component referred to as slide plate 76 is seen in FIG. 1 in exploded position in front of the main apparatus, and is also identified by the same number in FIG. 8. Also in FIG. 8 are shown the stationary cover plate 79, the frame member 75, and both components 81 and 82 of the movable block 80. The gap 82' is also visible in FIG. 8, and the remainder of the smaller components shown in FIG. 9 are seen in FIG. 8 to a smaller scale. These have not been identified by numerals in FIG. 8 in order to avoid cluttering the drawing.

The means by which the slide plate 76 and the anvil 77 are moved leftwardly in the first phase described above with reference to FIGS. 9 and 10 involves a wedge member 97. This is visible in both FIGS. 1 and 8. Referring to FIG. 1, it can be seen that the wedge member 97 tapers upwardly, and is attached to a cylinder 98, the bottom end 99 of which is fixed to a bracket 100 which is secured with respect to an immovable component 101 of the frame of the apparatus. When the cylinder extends its piston upwardly, thus moving the wedge member 97 upwardly (the wedge being shown in ghost outline in FIG. 1), the slide plate 76 is caused to move leftwardly. As can be seen in FIG. 1, the mating edges of the slide plate 76 and the wedge 97 are vertical (i.e. aligned with the guideway 12), whereas the other or rightward side of the wedge member 97 is oblique. This means that the mating portion 103 (FIG. 8) of the frame member 75 must also be oblique, and this is the case as seen in FIG. 1.

It can also be seen in FIG. 1 that the slide plate 76 has rectangular registration portions 104 at both the top and the bottom thereof, and extending both rearwardly and forwardly. There are thus four portions 104 in all, each containing a spring 104*a* and a return plunger 104*b*. These portions 104 register pair-wise in recesses 105 of the cover plate 79, and recesses 106 in the frame member 75. These recesses are wider laterally than the portions 104, to allow for sliding motion of the slide plates 76.

Thus, it will be understood that, in order to bring the slide plate 76 leftwardly from the position of FIG. 9 to the position of FIG. 10, the wedge member 97 accomplishes this motion by moving upwardly, under the urging of the cylinder 98. It should be noted that wedge 97 and the urging cylinder 98 can be substituted by a number of mechanical devices. A partial list includes cam means, an eccentric screw urged by an electric motor or air motor, an air cylinder, a hydraulic cylinder, a hydralic motor or lever or any combination thereof. When the slide plate 76 has moved far enough to grip the nut 17' between the components 77 and 84, the back pressure in the feed for the cylinder 98 causes a pressure valve to open, and upward movement of the wedge member 97 is halted. The opening of the pressure valve (not shown) also passes a signal to the logic of the machine (not forming a part of this invention), which thereupon initiates movement of the movable block 80, including its two components 81 and 82. The prime mover for this motion is a single-acting cylinder 108, which is located in a recess 109 in a frame 73. The cover 110 for the recess 109 has been shown in exploded position, to reveal the cylinder 108, and the mechanisms with which it is connected. Reference should be had at this point simultaneously to FIGS. 1 and 8.

A threaded shaft 112 is the member which actually pulls the movable block 80 to the right, in order to accomplish the deformation of the nut. The shaft 112 is threaded through block 80 to provide adjustment for various nut sizes. The shaft 112 is also shouldered into a block 114 having two pivotal connections 116, to each of which a rocker arm 118 is pivoted. Each rocker arm 118 bears pivotally against pins 119, and has a rightwardly extending portion terminating in supported rollers 120. The rollers are adapted to bear against a wedge block 122, which has two differently sloped portions that can be thrust leftwardly between the rollers, through the action of the cylinder 108. It will thus be understood that, when the cylinder 108 moves its piston leftwardly, the wedge block 122 is thrust between the rollers 120, thus urging the rockers arms 118 outwardly away from each other, thus rocking each one of them in the opposite sense about its respective pin 119, thus pulling the block 114 rightwardly, and also pulling the threaded shaft 112 rightwardly (as seen in FIG. 1 and 8). The rightward motion continues until contact is made between the wedge 81 and the frame member 75, as described above with respect to FIG. 11. By this point in time, the respective nut has been deformed to precisely the right degree, as explained earlier. A microswitch 124 secured to a table 126 is adapted to be activated by an adjustable contact 127 secured through a bracket 129 to the movable block 80. Thus, upon completion of the deformation of a nut, the microswitch 124 is activated, to tell the logic of the machine to complete the cycle by withdrawing the wedge 97 downwardly, allowing block 76 to move rightwardly (as seen in FIG. 8) and urging the block 82 leftwardly by the action of spring 138. Prior to the beginning of a new cycle, the push arm 71 has returned to its uppermost position to grasp another nut, and then a new cycle starts with the downward thrust of the push arm 71 to bring that new nut into a position in which it can subsequently be deformed, thereby ejecting the deformed nut. The logic receives a signal from the push arm connections to tell it that the nut is in position for deformation, due to a contact post 131 attached to the arm 57 (see FIG. 6). This post 131 is adjusted to contact another microswitch 133, which is affixed to the base plate 60. The bracket 74 is intended to be secured where shown by the broken line at the left in FIG. 1 (and where shown in place in FIG. 8), and has an adjustable stop 135 by which to establish a limit to the leftward motion of the movable block 80. A slidable shaft 136 is in a suitable bore axially of the threaded shaft 112, and a compression coil spring 138 (see FIG. 8) leftwardly of the shaft 136 tends to push the shaft 112 and the wedge block 122 away from each other, in order to return the single-acting piston 108 to its position prior to being activated (with its piston rightwardly), and to return the movable block 80 leftwardly to the position established by the adjustable stop 135.

Appropriate portions in FIG. 7 have been numbered, but these do not need to be discussed in detail with the exception of a stop 140, which is built into the block 76, and which acts to prevent the nut from moving upwardly after it has been positioned. The push arm 71 returns before squeezing takes place, and may exert a certain degree of upward pull on the deformed nut in so doing. The detent or stop 140 acts to prevent displacement of the nut under the influence of this upward pull. The stop 140 is part of an elongated arm 142, which is spring biased by spring 143 in a clockwise sense about a pivot 144, as seen in FIG. 7. This tends to bring the "nose" 146 of the stop 140 out into an interfering position with respect to the nut 17'. As can be seen the arm 142 is located in a recess 148 in the anvil.

As can be seen in FIG. 6, a fixed frame member 150 is shaped to define a slideway in which the movable block 80 can slide.

Figure 14:
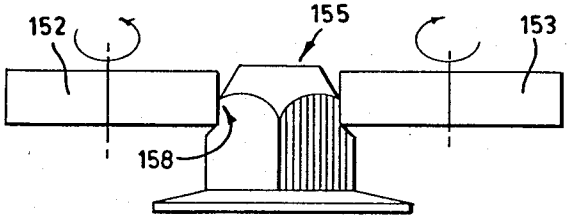
FIG. 14 PRIOR ART

A further aspect of this invention lies in the finished configuration of the squeezed nut, owing to the angulated faces 77' and 84', as seen in FIG. 9. To explain this advantage fully, attention is directed to FIGS. 14–16. FIG. 14 shows one of the methods utilized in the prior art for deforming a nut. In this prior art method, the top of the nut 155 is passed through two rolls, 152, 153 set at a fixed spacing, which deforms the nut 155. The resulting deformation utilizing this prior art method is such that the magnitude of deformation varies, depending on the size across the flats of the nut to be squeezed. If the nut 155 is at the bottom of tolerance the squeeze is slight, and if the nut is at the top of the tolerance the squeeze is too much (causes socket interference). The undersqueezed nut 155 will often have insufficient contact 158 with an undersized bolt, i.e. a bolt which is at the lower end of the tolerance range.

This prior art procedure results in a sudden shoulder region 158 and may cause sockets to partially engage or to slide on to the nut 155 in a very jerky manner.

Figure 15:
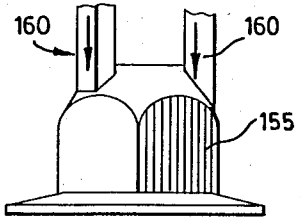
FIG. 15 PRIOR ART
FIGS. 14 and 15 are elevational views of prior art nut-deforming procedures.

FIG. 15 illustrates another method known in the prior art, in which three distortion members 160 (one of these being hidden behind the illustrated member to the left) descend to the cone or top flat of the nut and through a pressing action distort the cone or the top of the nut. The disadvantages of this system are that (a) the nut distortion area is not oval and consequently not as flexible, (b) binding only extends down a few threads and (c) testing on maximum and minimum bolts shows some inability to perform to specified torques.

Figure 16:
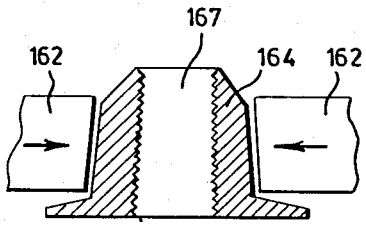
FIG. 16 is a sectional view of a nut deformed by the process of this invention, taken on the line 16—16 in FIG. 12.

The distortion system of the present invention is illustrated in FIG. 16, in which distortion members 162 (corresponding to the anvil faces 77' and 84' in FIG. 9) move inwardly against opposing flats of a nut 164, and have a slight slope upwardly and inwardly with respect to the nut 164. This results in a smooth and graduated transition from a circular entry opening 166 at the bottom to an oval top opening 167. By thus providing a nut in which the full height and width of two opposing nut flats is angularly side-squeezed, there is permitted a graduated interference with a bolt from top to bottom, without functional distortion of the entrance thread of the nut. Further, the squeeze is such that no sharp ridges or damage occurs to the flat in such a way as to interfere with wrenches or sockets. For each size of nut, the amount and angle of squeeze can be predetermined so that the bolt and nut assembly will not only meet prevailing torque specifications but will also do so for maximum and minimum bolt size tolerances. Since squeeze takes place while the nut is not in motion, no damage is occasioned to the washer face.

While a preferred embodiment of this invention has been described above and illustrated in the accompanying drawings, it will be apparent to those skilled in the art that changes and modifications may be made therein without departing from the essence of this invention, as set forth in the appended claims.

What is claimed is:

1. A method of making a prevailing torque nut from a regular nut that includes at least one pair of opposed external facets, said method comprising the steps:

(a) placing the regular nut between two anvil members which have oblique working faces, the nut being oriented so that said opposed facets face the anvil members, (b) decreasing the spacing between the anvil members so that they contact the facets over substantially the full axial height of the nut, and (c) further decreasing the spacing between the anvil members by a preset amount, to permanently inwardly deform the nut in a gradulated manner.

2. The method claimed in claim 1, in which step (b) is performed by maintaining one anvil member stationary and moving the other anvil member toward it, and step (c) is performed by maintaining said other anvil member stationary and moving said one anvil member toward said other anvil member.

3. The method claimed in claim 1, in which the anvil members have oblique working surfaces.

4. The method claimed in claim 1, in which the regular nut is a hexagonal nut with an integral washer at one end, and in which the anvil members are undercut to allow for the integral washer.

5. The method of making a prevailing torque nut from a regular hexagonal nut having an integral washer at one end, the nut having an internally threaded bore, the method comprising the steps:

(a) placing the regular hexagonal nut between two anvil members having oblique flat working surfaces extending over substantially the full axial height of the nut except for the integral washer, (b) decreasing the distance between the anvil members to bring them into contact with the nut, and (c) further decreasing the distance between the anvil members to cause an inward deformation of the nut which increases smoothly and progressively from one end of the nut to the other, the slope of the working surfaces of the jaws being such that, after inward deformation of the nut, the threads at the washer end of the nut remain substantially undeformed.

6. The method claimed in claim 5, in which step (b) is performed by urging a wedge block into a tapering cavity of which one tapering surfce is defined on a member connected to one anvil member, and the other tapering surface is fixed.

7. A method of feeding a hexagonal nut to a location between two parallel anvil members in such a way that the nut is oriented with two opposed flats parallel with the anvil members, the method comprising the steps:

passing the nut along a first track defined between first and second edges spaced apart a distance greater than the corner-to-corner diametral dimension of the nut, providing a second track continuous with the first track and defined between third and fourth edges spaced apart by a distance greater than the flat-to-flat diametral dimension of the nut but less thn the corner-to-corner corner diametral dimension thereof, laterally adjacent the junction between the two tracks reciprocating a contact element longitudinally of the tracks while allowing the element some lateral freedom of movement, whereby if the nut tries to enter the second track, the contact element rotates the nut so that its flat dimension is across the track.

8. A method of making a plurality of prevailing torque nuts with a substantially consistent degree of deformation from a plurality of regular nuts of the same size range, the method comprising the steps:

(a) placing the regular nuts sequentially between two anvil members having oblique working surfaces (b) for each nut, decreasing the gap between the anvil members until they contact the nut on opposite sides thereof substantially over the full axial height thereof, and (c) further decreasing said gap by a predetermined amount which is the same for all the nuts in the said size range, to permanently inwardly deform the nut in a smooth and progressive manner from one end of the nut to the other.

9. The method claimed in claim 8, in which step (b) is performed by maintaining one anvil member stationary and moving the other anvil member toward it, and step (c) is performed by maintaining said other anvil member stationary and moving said one anvil member toward said other anvil member.

10. Apparatus for converting regular nuts into prevailing torque nuts, comprising:

two anvil members, having oblique working surfaces, delivery means for placing the regular nuts sequentially between the anvil members, power means for controlling the spacing between the anvil members such that (a) the anvil members first come into contact with the opposite sides of a nut located between them over substantially the full axial height of the nut, and then (b) the spacing between the anvil members decreases by a predetermined amount which is the same for all nuts within a given size range, whereby to permanently inwardly deform each nut in a smooth and progressive manner from one end of the nut to the other.

11. The apparatus claimed in claim 10, in which the power means controls the anvil members such that step (a) results from the movement of one anvil member and step (b) results from the movement of the other anvil member.

12. The apparatus claimed in claim 11, in which said one anvil member is part of a first slidable assembly partly defining a tapering activity into which a wedge member is inserted.

13. The apparatus claimed in claim 12, in which said other anvil member is part of a second slidable assembly which is moved toward said one anvil member by a force-multiplying mechanism operated by a cylinder.

14. The apparatus claimed in claim 10, in which the anvil members have anvil surfaces which are sloped at an angle of between 3° and 7° with respect to a plane normal to the direction of movement of the anvil members.

15. The apparatus claimed in claim 10, in which the delivery means includes:

a first track defined between first and second edges spaced apart a distance greater than the corner-to-corner dimension of the nut, a second track continuous with the first track and defined between a continuation of said first edge and a third edge spaced from said first edge by a distance greater than the flat-to-flat dimension of the nut but less than the corner-to-corner dimension thereof, and a contact element located at the junction between said second and third edges, and means for reciprocating said contact element longitudinally in the tracks while allowing the element some lateral freedom of movement, whereby if a nut tries to enter the second track with its corner-to-corner dimension across the track, the contact element will rotate the nut so that its flat-to-flat dimension is across the track.

16. The apparatus claimed in claim 15, in which the contact element is resiliently biased towards said first edge.

17. A delivery apparatus for feeding a hexagonal nut to a location between two parallel anvil members in such a way that the nut is oriented with two opposed flats parallel with the anvil members, the apparatus comprising:

a first track defined between first and second edges spaced apart a distance greater than the corner-to-corner dimension of the nut, a second track continuous with the first track and defined between third and fourth edges spaced apart by a distance greater than the flat-to-flat dimension of the nut but less than the corner-to-corner dimension thereof, the second track leading to the location between the anvil members, and a contact element located at the junction between the two tracks, and means for reciprocating the contact element longitudinally of the tracks while allowing the element some lateral freedom of movement, whereby if a nut tries to enter the second track with its corner-to-corner dimension across the track, the contact element rotates the nut so that its flat-to-flat dimension is across the track.

* * * * *